United States Patent [19]

Katayama et al.

[11] Patent Number: 4,457,286

[45] Date of Patent: Jul. 3, 1984

[54] ENGINE IGNITION SYSTEM

[75] Inventors: Hiroomi Katayama, Tokyo, Masahiko Fujii, Kanaqawa; Yoshiaki Hirosawa, Saitama, all of Japan

[73] Assignees: New Nippon Electric Co., Ltd., Osaka; Honda Geken Kogyo Kabushiki Kaisha, Tokyo, both of Japan

[21] Appl. No.: 393,322

[22] Filed: Jun. 29, 1982

[30] Foreign Application Priority Data

Jun. 30, 1981 [JP] Japan ..... 56-100491

[51] Int. Cl.[3] ..... F02P 9/00

[52] U.S. Cl. ..... 123/612; 123/617; 123/643

[58] Field of Search ..... 123/612, 613, 617, 630, 123/643, 414, 640, 146.5 A, 476, 477, 490

[56] References Cited

U.S. PATENT DOCUMENTS 4,265,211 5/1981 Meloeny ..... 123/643
4,317,437 3/1982 Lindgren ..... 123/414
4,378,004 3/1983 Petrie ..... 123/414

FOREIGN PATENT DOCUMENTS 55-104569 8/1980 Japan ..... 123/617

*Primary Examiner*—Andrew M. Dolinar

[57] ABSTRACT

An engine ignition system connected between an engine crank and ignition coils includes a reference position signal generating device having reference position sensors, and a crank angle sensing device. The ignition system also includes a signal processing device which receives both the reference position signals and crank angle signals, and when one of the reference position signals is absent continues to generate ignition control signals which activate the ignition coils. The signal processing device includes a counter which counts the crank angle signals and which is reset by the reference position signals, and a decoder which produces a signal when a count value reaches a predetermined count. The signal processing device also includes a logic circuit and a flip-flop for producing either primary ignition control signals or replacement ignition control signals. The replacement ignition control signals are generated when one of the reference position signals is absent.

10 Claims, 8 Drawing Figures

FIG. 4(a)

| | | | | | | | | | | | | |
|---|---|---|---|---|---|---|---|---|---|---|---|---|
| #1 | ○ | (EXP) | EXH | × | SUC | COMP | ○ | (EXP) | EXH | | | |
| #3 | COMP | ○ | (EXP) | EXH | × | SUC | COMP | ○ | (EXP) | | | |
| #4 | SUC | COMP | ○ | (EXP) | EXH | × | SUC | COMP | | | | |
| #2 | EXH | SUC | COMP | ○ | (EXP) | EXH | × | SUC | | | | |

FIG. 4(b)

| | | | | | | | | | | | | |
|---|---|---|---|---|---|---|---|---|---|---|---|---|
| #1 | ○ | (EXP) | EXH | × | SUC | COMP | ○ | (EXP) | EXH | | | |
| #2 | COMP | ○ | (EXP) | EXH | × | SUC | COMP | ○ | (EXP) | | | |

ENGINE IGNITION SYSTEM

BACKGROUND OF THE INVENTION

The present invention relates to an engine ignition system for maintaining the generation of ignition control signals even when part of an ignition timing control system is malfunctioning.

The ignition timing of the engine is controlled using a reference position detecting sensor for detecting the position of the engine pistons. In the prior art pulses are generated to control the ignition timing by arithmetically processing both a signal from a reference position detecting sensor and a signal from a crank angle detecting sensor which detects the rotational angle of the engine. Within the reference position detecting sensor is a magnetic sensor containing a fine wire coil which can be broken. If the coil breaks, the reference position detecting signal is not generated and the engine will not run.

SUMMARY OF THE INVENTION

It is an object of the present invention to provide an ignition system for generating ignition pulses at a proper timing even when a reference position detecting sensor is malfunctioning and a reference position detecting signal is blocked.

The present invention includes an engine crank angle sensing device which generates crank angle signals, and a reference position signal which generates device generating reference position signals. The invention also includes a signal processing device connected to a switching circuit for the engine ignition coils. The signal processing device detects the loss of one of the reference position signals and generates a replacement signal. The signal processing device includes a counter which counts the crank angle signals, and a decoder which outputs a signal when the count reaches a predetermined value. The signal processing device also includes a logic circuit connected to the decoder, a flip-flop, the switching circuit and the reference position signal generating device. The logic circuit generates the replacement signals when one of the reference position signals is absent and the decoder outputs a signal.

These together with other objects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 4(*a*) is a table tabulating crankstrokes of a series four-cylinder engine;

FIG. 4(*b*) is a table tabulating crankstrokes of a series two-cylinder engine;

DESCRIPTION OF THE PREFERRED EMBODIMENTS

Engines of existing vehicles are classified into the following categories: series two-cylinder, series four-cylinder, series six-cylinder, V-type two-cylinder having a 360 degree crank, and a series two-cylinder having a 180 degree crank. Each of these types of engines have different positions for mounting reference position detecting sensors because of their different cylinder arrangements.

Figure 1:
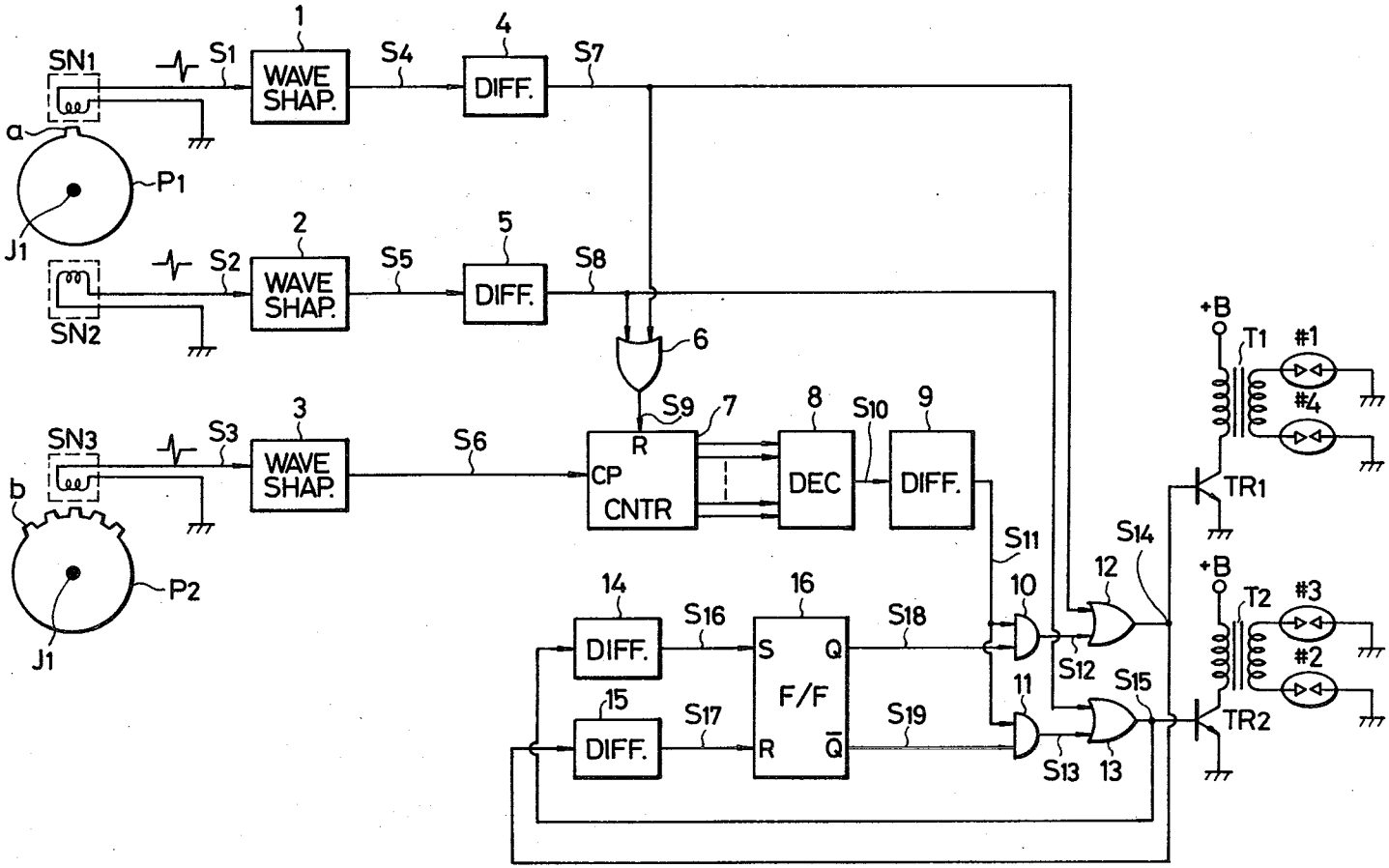
FIG. 1 is a block diagram illustrating a first embodiment of an engine ignition system according to the present invention.

A block diagram of a first embodiment of the present invention is illustrated in FIG. 1 and is applied to the series four-cylinder engine having a 360 degree crank and a series two-cylinder engine having a 180 degree crank.

Reference magnetic disc $P_1$ is secured to a crankshaft $J_1$ of the engine by a second shaft or other device for rotating the disc $P_1$ and has formed on the outer circumference of the disc $P_1$ a tooth a. Reference magnetic sensors $SN_1$ and $SN_2$ are positioned about the periphery of the magnetic disc $P_1$ at diametrically opposite positions so that they act as reference position detecting magnetic sensors. Each time tooth a of the magnetic disc $P_1$ passes either of the magnetic sensors $SN_1$ or $SN_2$ because of the rotation of the crankshaft $J_1$, the corresponding magnetic sensor $SN_1$ or $SN_2$ generates a pulse signal $S_1$ or $S_2$. Crank angle magnetic disc $P_2$ is also secured to crankshaft $J_1$ by a shaft or other device for rotating the disc $P_2$ and has formed on its outer circumference 180 teeth b spaced 2 degrees apart. A crank angle magnetic sensor $SN_3$ generates a pulse signal each time one of the teeth b of the magnetic disc $P_2$ rotates past the magnetic sensor $SN_3$ due to the rotation of the crankshaft $J_1$. In other words, when the crankshaft $J_1$ rotates 2 degrees a pulse signal $S_3$ is generated.

Waveform shaping circuits 1, 2 and 3 receive the pulse signals $S_1$, $S_2$ and $S_3$, respectively. The pulse signals $S_1$ and $S_2$ have their waveforms shaped so that square wave signals $S_4$ and $S_5$ having identical pulse widths are produced by the waveform shaping circuits 1 and 2. The waveform shaping circuit 3 produces a square wave signal $S_6$ which has a smaller width than signals $S_4$ and $S_5$. Signal $S_6$ is used as a crank angle pulse signal for indicating the unit angle rotation of the crankshaft $J_1$. A trailing edge differential circuit 4 receives the square wave signal $S_4$ and generates differential pulses by differentiating the trailing edge of the square wave signal $S_4$. The differential pulses are used as first reference position pulses $S_7$. A trailing edge differential circuit 5 also generates differential pulses, by differentiating the trailing edge of the square wave signal $S_5$, and these differential pulses are used as second reference position pulses $S_8$. An OR circuit 6 receives the first and second reference position pulses $S_7$ and $S_8$ and generates a pulse signal $S_9$ which is the logical sum of the pulses $S_7$ and $S_8$. A counter 7 receives the crank angle pulses $S_6$ at its clock pulse input terminal CP and receives the signal $S_9$ at its reset terminal R. Counter 7 counts 90 pulses within the signal $S_6$ and outputs the counted value in a binary code. The counter 7 is normally cleared by the signal $S_9$ which is produced before the counted value reaches 90, so that all the counted value outputs are held at a low level. A decoder 8 receives the counted value binary code generated by the counter 7 and determines whether the signal $S_9$ is received by the counter before a predetermined timing. When the counted value is greater than or equal to 90 a pulse signal $S_{10}$, having a predetermined pulse width, is generated. A leading edge differential circuit 9 receives the signal $S_{10}$ and generates differential pulses $S_{11}$ by differentiating the leading edge of the signal $S_{10}$. An AND circuit 10 receives both the pulse signal $S_{11}$ and a later-described pulse signal $S_{18}$ and generates a signal $S_{12}$. An AND circuit 11 receives both the pulse signal $S_{11}$ and a later-described signal $S_{19}$ and generates signal $S_{13}$. An OR circuit 12 receives the signal $S_7$ from the trailing edge differential circuit 4 and the signal $S_{12}$ from AND gate 10, and generates a signal $S_{14}$ which is the logical sum of the input signals. An or gate 13 receives the signal $S_8$ from the trailing edge differential circuit 5 and the signal $S_{13}$ from the AND gate 11, and generates a signal $S_{15}$ which is the logical sum of the input signals. A trailing edge differential circuit 14 generates differential pulses by differentiating the trailing edge of the signal $S_{15}$ and a trailing edge differential circuit 15 generates differential pulses $S_{17}$ by differentiating the trailing edge of the signal $S_{14}$. A flip-flop circuit 16 receives at its set terminal S the differential pulses $S_{16}$ and at its reset terminal R the differential pulses $S_{17}$, and outputs from its output terminals Q and $\bar{Q}$, the pulse signals $S_{18}$ and $S_{19}$, respectively, which are inverted with respect to each other.

The signal $S_{14}$ is received by the base of a transistor $TR_1$ which comprises a switching circuit for an igniter and which has its emitter grounded. The collector of transistor of $TR_1$ is connected to a primasry winding terminal of an ignition coil T1. The other terminal of the primary winding coil T1 has a voltage +B applied thereto. The secondary winding of the ignition coil T1 has one terminal grounded through an ignition plug #1 nad its other terminal grounded through an ignition plug #4. Similarly, the signal $S_{15}$ is received by the base of transistor $TR_2$ which comprises a switching circuit for an igniter and which has its emitter grounded. The collector of transistor $TR_2$ is connected to a primary winding terminal of ignition coil $T_2$. The other terminal of the primary winding has applied thereto the voltage +B. The secondary winding of ignition coil $T_2$ has one terminal grounded through an ignition plug #3 and has its other terminal grounded through an ignition plug #2.

Figure 2:
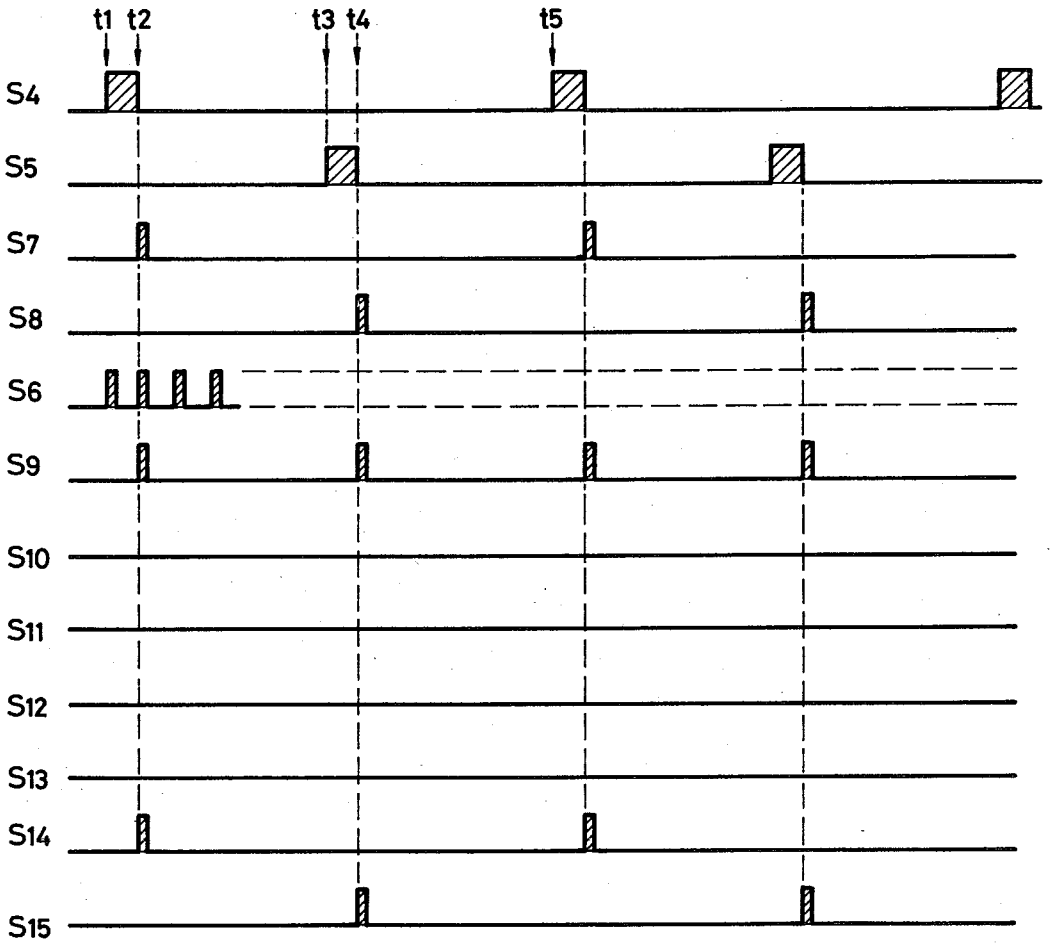
FIG. 2 is a time chart illustrating signals in the circuit of FIG. 1 in its normal state.

The operation of the circuit illustrated in FIG. 1 will be described with reference to FIG. 2 which illustrates a time chart for the signals in the circuit during normal operation.

At a time between $t_1$ and $t_2$ when the tooth a of magnetic disc $P_1$ passes the magnetic sensor $SN_1$, the pulse signal $S_1$ is generated and output as the square wave signal $S_4$. At a time between $t_3$ and $t_4$ when the engine has rotated 180 degrees, the pulse signal $S_2$ is generated when tooth a passes magnetic sensor $SN_2$ and is output as square wave signal $S_5$. When the trailing edge differential circuit 4 detects the trailing edge of the signal $S_4$, the position detection pulse $S_7$ is generated at the time $t_2$. When the trailing edge differential circuit 4 detects the trailing edge of the signal $S_5$ another position detection pulse $S_8$ is generated at the time $t_4$. As a result, the signal $S_9$ which is composed of both the position detection pulses $S_7$ and $S_8$, becomes high, and the counter 7 is reset by signal $S_9$ each time the engine makes one half of a rotation. During this time the clock pulse terminal CP of the counter 7 receives the square wave signal $S_6$ which is obtained from the waveshapping circuit 3 which shapes the crank angle pulses $S_3$ generated each time the engine rotates 2 degrees. If the counter 7 counts 90 square waves the decoder 8 outputs the signal $S_{10}$. However, in a normal operating state, the counter 7 is reset by the signal $S_9$ before the count reaches 90 and the signal $S_{10}$ is held unchanged at a low level. As a result, the output signal $S_{11}$ generated by the leading edge differential circuit 9 is held at the low level, and the signals $S_{12}$ and $S_{13}$ output by the AND circuits 10 and 11, respectively, are also held at the low level. Consequently, signal $S_{14}$ output by the OR circuit 12 is coincident with the position detection pulses $S_7$, and the signal $S_{15}$ output by the OR circuit 13 is coincident with the position detection pulses $S_8$. Thus, each time the crankshaft $J_1$ makes a half rotation, the signals $S_{14}$ and $S_{15}$ are generated, and act as ignition control signals to alternately activate the transistors $TR_1$ and $TR_2$ of the igniters. The signals activating the transistors $TR_1$ and $TR_2$ are output as voltage-boosted pulses to the secondary terminals of the ignition coils $T_1$ and $T_2$ thereby consecutively sparking the ignition plugs #1 to #4.

Figure 3:
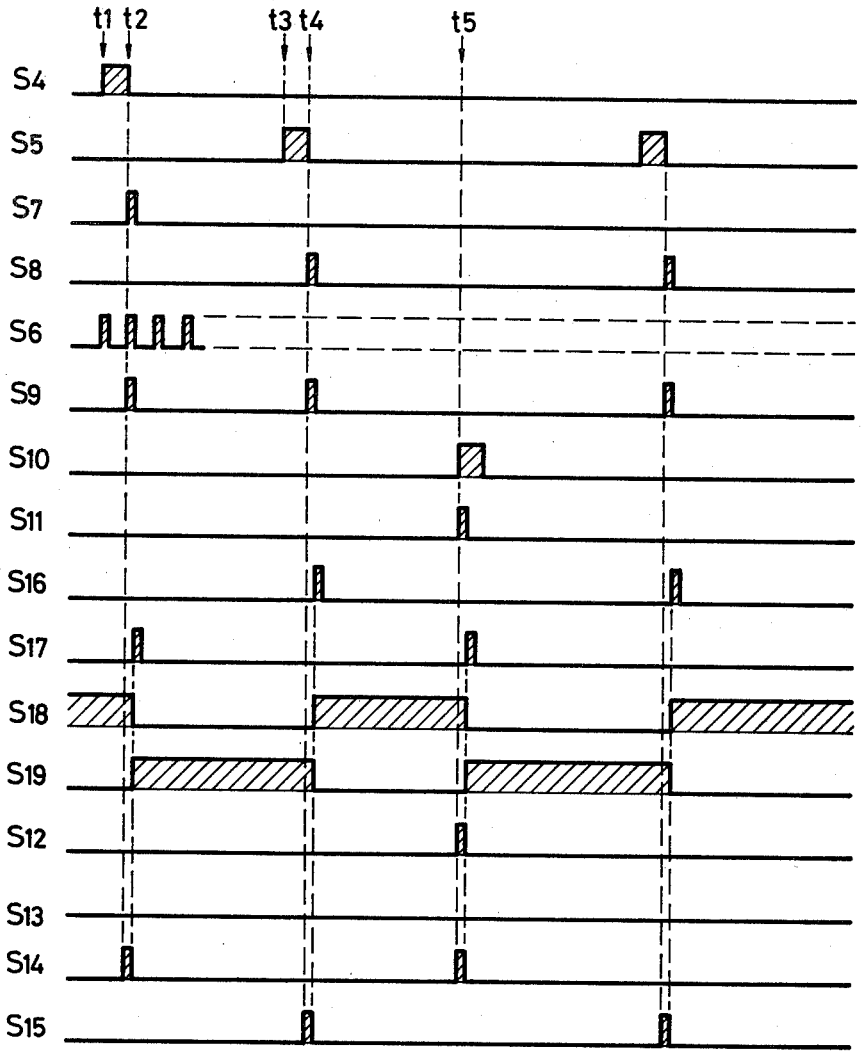
FIG. 3 is a time chart illustrating signals in the circuit of FIG. 1 in an abnormal state.

The operation of the circuit illustrated in FIG. 1 in an abnormal state when the magnetic sensors $SN_1$ or $SN_2$ have their coils broken will be described with reference to FIG. 3. For this example it is assumed that the magnetic sensor $SN_1$ is broken during the period between time $t_4$ and time $t_5$.

Since the position detection pulse $S_7$ is generated at time $t_2$, the ignition control signal $S_{14}$ dependent thereon turns the transistor $TR_1$ on and off, so that the ignition plugs #1 and #4 are alternately sparked. At the time $t_4$, since the ignition detection pulse $S_8$ is generated, the ignition control signal $S_{15}$ is generated turning the transistor $TR_2$ on and off, so that the ignition plugs #2 and #3 are alternately sparked. If it is assumed that the magnetic sensor $SN_1$ has its coil broken after the time $t_4$ the square wave signal $S_4$ is not generated at time $t_5$, so that the position detection pulse $S_7$ is not generated. Since the flip-flop circuit 16 is held in its set state by the ignition control signal $S_{15}$, generated at the time $t_4$, the output signal $S_{18}$ of the flip-flop circuit 16 is held at a high level, while the inverted output signal $S_{19}$ is held at the low level. The counter 7 counts the crank angle pulses S6 starting from the time $t_4$ but is not reset at the time $t_5$, so that the square wave signal $S_{10}$ is generated indicating a count greater than or equal to 90. Since the differential signal $S_{11}$ is produced from the rising edge of the signal $S_{10}$ by the differential circuit 9, and since both signal $S_{11}$ and $S_{18}$ are at the high level, the signal $S_{12}$ is output by the AND gate 10, so that the replacement ignition control signal $S_{14}$ is generated. Thus, the engine ignition system generates the ignition control signal without deficiency. As a result, in spite of the breakage of the coil of the magnetic sensor $SN_1$, the ignition plugs #1 and #4 are sparked. In a similar manner, even if the magnetic sensor $SN_2$ has a broken coil, the ignition plugs #2 and #3 will operate normally.

The crank steps of the engines are tabulated for reference in FIG. 4. FIG. 4(*a*) tabulates the crank steps of the series four-cylinder engine having a 360 degree crank and FIG. 4(*b*) tabulates the crank steps of the series two-cylinder engine having a crank of 180 degrees. In FIGS. 4(*a*) and 4(*b*), the circled letters EXP indicate the explosion stroke, the letters EXH indicate the exhaust stroke, the letters SUC indicate the suction storke, and the letters COMP indicate the compression stroke. The circles locted on the dividing lines between the different strokes indicate effective ignitions and the X's indicate ineffective ignitions.

Figure 5:
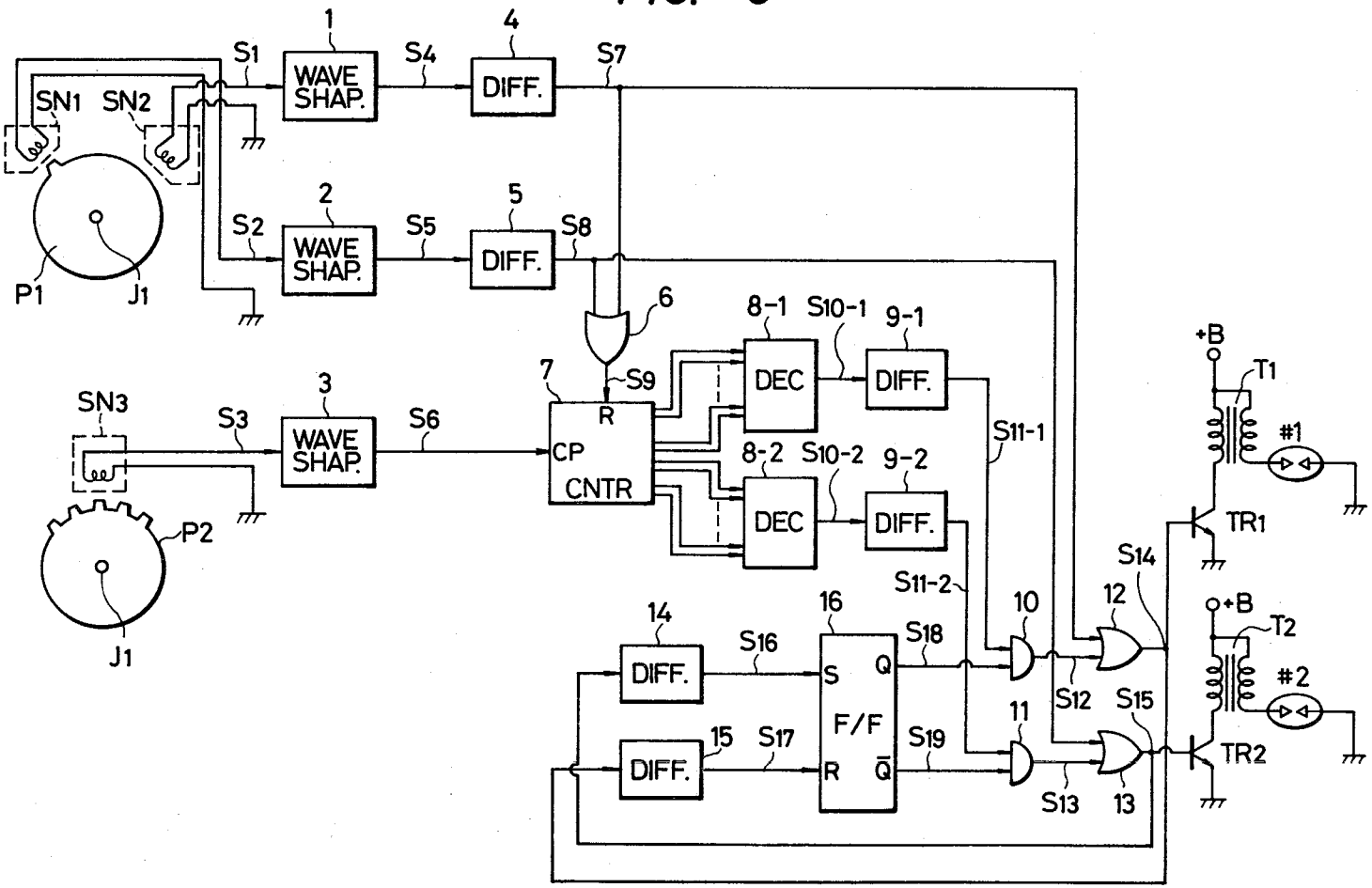
FIG. 5 is a circuit diagram illustrating a second embodiment of the present invention.

FIG. 5 is a circuit diagram illustrating a second embodiment of the present invention. FIG. 5 illustrates an ignition pulse generating system which is applied to the V-type two-cylinder engine. For this configuration the magnetic sensors $SN_1$ and $SN_2$ which act as the reference position detecting sensors, are arranged about the circumference of magnetic disc $P_1$ and spaced 80 degrees apart. The circuit illustrated in FIG. 5 has substantially the same construction as that illustrated in FIG. 1, but is different in the portions corresponding to the decoder 8 and the leading edge differential circuit 9. As previously described, the counter 7 counts the crank angle pulses $S_6$ received at the clock pulse terminal CP and generates a counted value as the binary pulse signal. If the reset input signal $S_9$ arrives before the counted value reaches 40, the decoder 8-1 generates an output signal $S_{10-1}$ at a low level. If the reset input signal $S_9$ arrives after 40 pulses have been counted, square wave signal $S_{10-1}$ having a predetermined width and a high level is output by the decoder 8-1. A decoder 8-2 has its output signal $S_{10-2}$ held at the low level if the reset input signal $S_9$ arrives before the counter 7 counts 140 pulses $S_6$. The decoder 8-2 produces a square wave signal having a predetermined width and the high level if the reset input signal $S_9$ does not arrive. The decoders are well-known circuits which are comprised of a combination of AND gates.

The leading edge differential circuits 9-1 and 9-2 receive the square wave signals $S_{10-1}$, and $S_{10-2}$, respectively. The differential circuits differentiate the rising edge of the signals and generate differential outputs $S_{11-1}$ and $S_{11-2}$, respectively. The output signals $S_{11-1}$ and $S_{11-2}$ of the differential circuits are received by AND circuits 10 and 11, respectively. The primary and secondary wiring of ignition coils $T_1$ and $T_2$ each have one terminal which receives a +B voltage and each have another terminal connected to the ignition plugs #1 and #2, respectively.

The operation of the circuit illustrated in FIG. 5 will be described in its normal and abnormal states with reference to the time charts illustrated in FIGS. 6 and 7.

During normal operation the counter 7 is timely reset by the signal $S_9$. After the component of the signal $S_8$ has been received as the reset input signal $S_9$ the counter 7 is reset by the component of the signal $S_7$ when the count reaches 40, so that the output signals $S_{10-1}$ and $S_{10-2}$ produced by the decoders 8-1 and 8-2 are held at the low level. When the counter 7 counts 40 pulses $S_6$ after the arrival of the component of the signal $S_7$, the signal $S_{10-1}$ is produced which is a square wave having a predetermined width. The leading edge of this square wave is differentiated and passed as the signal $S_{11-1}$ to the AND circuit 10. However, AND circuit 10 has its output at the low level at this time, because the other input signal $S_{18}$ is at the low level. In other words, there is no change in the situation in which the signal $S_{10-1}$ is at the low level. When the counter 7 counts 140 pulses $S_6$, it is reset by the component of the subsequent signal $S_8$, so that the output $S_{10-2}$ of the decoder 8-2 is held at the low level. As a result, the output signals $S_{14}$ and $S_{15}$ produced by the OR circuits 12 and 13 are coincident with the position detection pulses $S_7$ and $S_8$, so that the ignition plugs #1 and #2 are alternately sparked due to the switching operations of the transistors $TR_1$ and $TR_2$.

Figure 6:
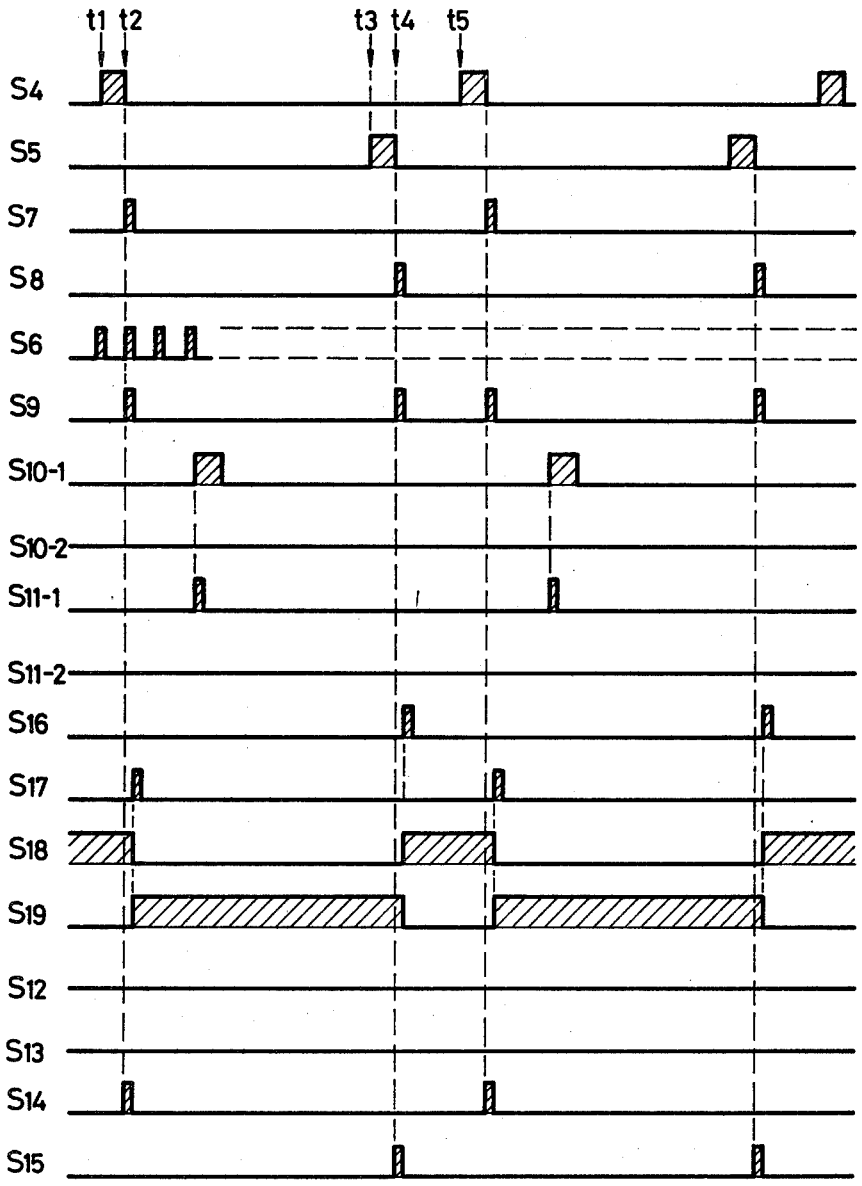
FIG. 6 is a time chart illustrating signals in the circuit of FIG. 5 in a normal state.
Figure 7:
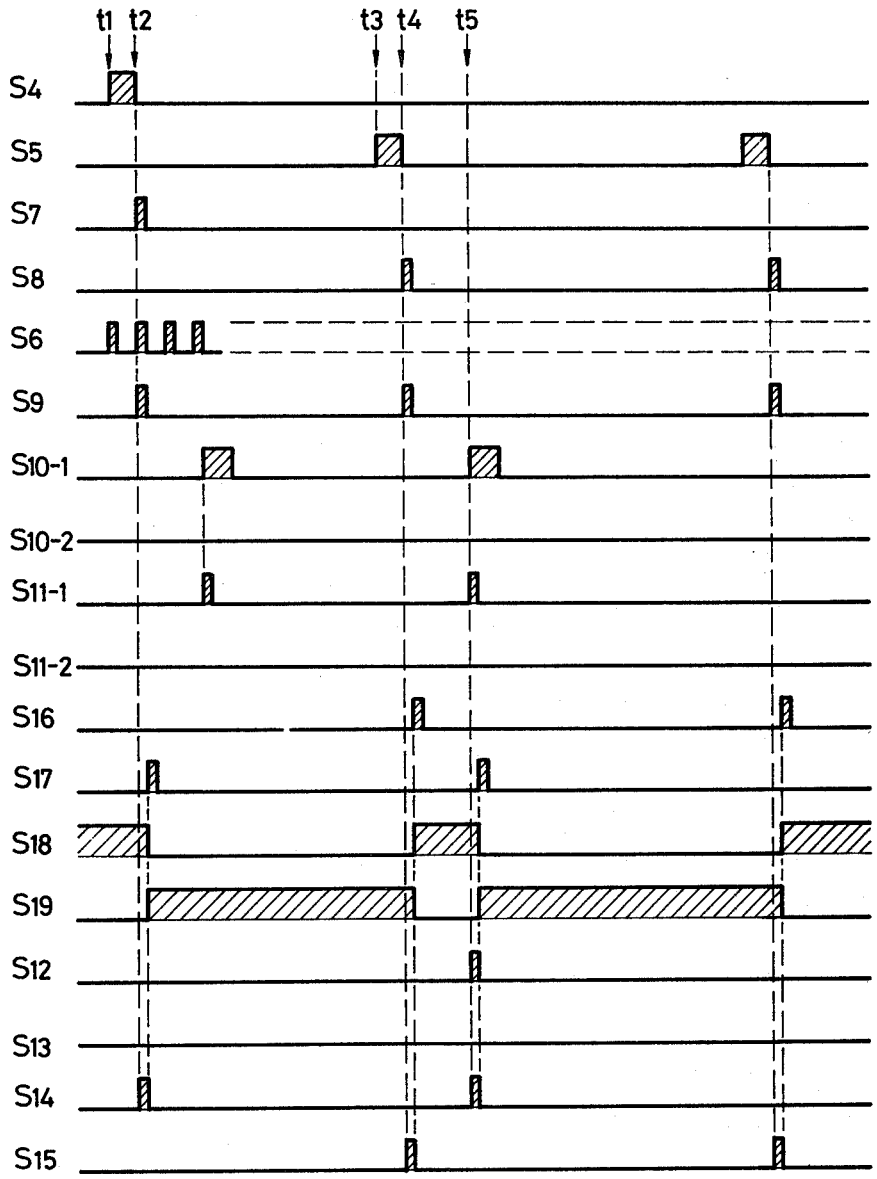
FIG. 7 is a time chart illustrating signals in the circuit of FIG. 5 in an abnormal state.

When the coil of one of the magnetic sensors $SN_1$ or $SN_2$ is broken, the operation of the circuit illustrated in FIG. 6 is illustrated in FIG. 7, and will hereinafter be described. For this example it is assumed that the magnetic sensor $SN_2$ has its coil broken during the period between time $t_4$ and time $t_5$.

Because a reset input signal $S_9$ is not present at the time $t_5$ when 40 pulses $S_6$ are counted, the output signal $S_{10-1}$ of the decoder 8-1 becomes a square wave having a predetermined width. The differential pulses $S_{11-1}$ which indicate the rising edge of the square wave are produced by the leading edge differential circuit 9-1. At this time, since the output $S_{18}$ of the flip-flop 16 is at the high level, the output signal $S_{12}$ produced by the AND circuit 10 is a pulse at the high level, so that the ignition control signal $S_{14}$ is produced by the OR circuit 12. As a result, even in the absence of the position detection pulses $S_7$ or $S_8$, the replacement ignition signal $S_{14}$ is generated so that the sparking operations of the ignition plug #1 continue. Alternatively, if the coil of the magnetic sensor $SN_1$ is broken, the replacement pulses for ignition control are similarly obtained as the signal $S_{15}$ produced by the output signal $S_{10-2}$ of the decoder 8-2, so that the normal running of the engine is maintained.

As has been hereinbefore described, according to the present invention, the ignition control signals can be generated at the normal operation timing even when the circuit for generating reference position detection pulses is malfunctioning in both the series four-cylinder engine having a 360 degree crank, or the series or V-type two-cylinder engine having a 180 degree crank. As a result, it is possible to prevent the engine from stopping.

The many features and advantages of the invention are apparent from the detailed specification and thus it is intended by the appended claims to cover all such features and advantages of the system which fall within the true spirit and scope of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed is:

1. An engine ignition system, operatively connected between an engine crank and sparkplug ignition coils, comprising:

crank angle sensing means, secured to the engine crank, for sensing the angle of the engine crank and for generating crank angle signals therefrom;

reference position signal generating means, secured to the engine crank, for sensing a reference position of the engine crank and for generating first and second reference position signals therefrom;

signal processing means, operatively connected to said crank angle sensing means and said reference position signal generating means, for generating primary ignition signals, said signal processing means including means for detecting the absence of the first or second reference position signals and for generating replacement ignition signals when either the first or second reference position signals are absent; and switch means, operatively connected between the sparkplug ignition coils and said signal processing means, for turning the ignition coils on in dependence upon the primary ignition signals or the replacement ignition signals.

2. An engine ignition system as recited in claim 1, wherein said means for detecting and generating comprises:

a counter, operatively connected to said crank angle sensing means and said reference position signal generating means, for counting the crank angle signals and being reset by the first and second reference position signals;

a decoder, operatively connected to said counter, for generating a decoder signal in dependence upon a predetermined count value counted by said counter;

a flip-flop for generating flip-flop signals;

a first logical circuit, operatively connected to said decoder and said flip-flop, for generating a logic signal in dependence upon the decoder signal and the flip-flop signals; and a second logic circuit, operatively connected to said reference position signal generating means, said first logic circuit, said flip-flop and said switch means, for generating the primary ignition signals or the replacement ignition signals in dependence upon the first reference pulse, the second reference pulse and the logic signal, the primary or replacement ignition signals setting and resetting said flip-flop.

3. An engine ignition system as recited in claim 2, wherein said means for detecting and generating further comprises:

a leading edge differential circuit operatively connected between said decoder and said first logic circuit;

a trailing edge differential circuit operatively connected between said second logic circuit and said flip-flop;

and an OR circuit operatively connected between said reference position signal generating means and said counter.

4. An engine ignition system as recited in claim 2, wherein said first logic circuit comprises first and second AND circuits operatively connected to said decoder, said flip-flop and said second logic circuit.

5. An engine ignition system as recited in claim 2, wherein said second logic circuit comprises first and second OR circuits operatively connected to said reference position signal generating means, said first logic circuit, said flip-flop and said switch means.

6. An engine ignition system as recited in claim 1, wherein said switch means comprises first and second transistors operatively connected between said means for detecting and generating and the ignition coils.

7. An engine ignition system as recited in claim 1, wherein said crank angle sensing means comprises:

a crank angle sensor means, secured to the engine crank, for sensing the angle of the engine crank and for generating the crank angle pulses therefrom; and a crank angle wave shaping circuit operatively connected to said crank angle sensor means and said signal processing means.

8. An engine ignition system as recited in claim 7, wherein said crank angle sensor means comprises:

rotating means, secured to the engine crank, for rotating at the same rate as the engine crank;

a crank angle magnetic disc secured to said rotating means and having teeth formed on the periphery of said crank angle magnetic disc;

and a crank angle magnetic sensor, positioned across from the periphery of said crank angle magnetic disc in the magnetic field of said crank angle magnetic disc, for generating the crank angle pulses each time one of the teeth passes said crank angle magnetic sensor.

9. An engine ignition system as recited in claim 1, wherein said reference position signal generating means comprises:

reference sensor means, secured to the engine crank, for sensing the reference position of the engine crank and for generating the first and second reference pulses therefrom;

first and second reference wave shaping circuits operatively connected to said reference sensor means; and first and second trailing edge differential circuits operatively connected between said signal processing means and said first and second reference wave shaping circuits, respectively.

10. An engine ignition system as recited in claim 9, wherein said reference sensor means comprises:

rotating means, secured to the engine crank, for rotating at the same rate as the engine crank;

a reference magnetic disc secured to said rotating means and having a tooth formed on the periphery of said reference magnetic disc;

a first reference magnetic sensor, positioned at a first position across from the periphery of said reference magnetic disc and in the magnetic field of said reference magnetic disc, for generating the first reference position pulse each time the tooth passes said first reference magnetic sensor; and a second reference magnetic sensor, positioned at a second position across from the periphery of said reference magnetic disc and in the magnetic field of said reference magnetic disc, for generating the second reference position pulse each time the tooth passes said second reference magnetic sensor.

* * * * *

UNITED STATES PATENT AND TRADEMARK OFFICE

CERTIFICATE OF CORRECTION

PATENT NO. : 4,457,286

DATED : July 3, 1984

INVENTOR(S) : Katayama et al

It is certified that error appears in the above-identified patent and that said Letters Patent is hereby corrected as shown below:

On the Title Page,

[73] Assignees, "Honda Geken Kogyo" should be --Honda Giken Kogyo--.

Column 3, line 31, "primasry" should be --primary--.

Column 4, line 66, "storke" should be --stroke--;
line 68, "locted" should be --located--.

Signed and Sealed this

Seventh Day of May 1985

[SEAL]

*Attest:*

DONALD J. QUIGG

*Attesting Officer*

*Acting Commissioner of Patents and Trademarks*